US006837239B2

(12) United States Patent
Beizndtsson et al.

(10) Patent No.: US 6,837,239 B2
(45) Date of Patent: Jan. 4, 2005

(54) VENTILATION SYSTEM FOR A PROTECTIVE SUIT

(75) Inventors: Goran B. C. Beizndtsson, New South Wales (AU); Lennart Backman, Varnamo (SE)

(73) Assignee: Safety Equipment Australia Pty Ltd. (AU)

( * ) Notice: Subject to any disclaimer, the term of this patent is extended or adjusted under 35 U.S.C. 154(b) by 158 days.

(21) Appl. No.: 10/195,881

(22) Filed: Jul. 22, 2002

(65) Prior Publication Data

US 2003/0024529 A1 Feb. 6, 2003

Related U.S. Application Data

(63) Continuation-in-part of application No. PCT/AU01/00384, filed on Apr. 3, 2001.

(30) Foreign Application Priority Data

Apr. 3, 2000 (AU) ..... PQ6644

(51) Int. Cl.[7] ..... A62B 7/10

(52) U.S. Cl. ..... 128/201.25; 128/201.29; 128/202.19

(58) Field of Search ..... 128/201.25, 201.29, 128/202.11, 202.19, 202.22

(56) References Cited

U.S. PATENT DOCUMENTS

| | | | | | |
|---|---|---|---|---|---|
| 174,286 | A | * | 2/1876 | Ostberg | 128/201.29 |
| 196,862 | A | * | 11/1877 | Bechtold | 128/201.29 |
| 642,166 | A | * | 1/1900 | Sherman | 128/201.29 |
| 896,447 | A | * | 8/1908 | Hall et al. | 128/201.25 |
| 1,931,562 | A | * | 10/1933 | Thompson | 128/201.25 |
| 2,144,611 | A | * | 1/1939 | Biggs | 128/201.25 |
| 2,390,233 | A | * | 12/1945 | Akerman et al. | 128/202.11 |
| 2,404,020 | A | * | 7/1946 | Akerman | 128/202.11 |
| 2,449,548 | A | * | 9/1948 | Burns | 128/202.11 |
| 2,824,557 | A | * | 2/1958 | Mejean et al. | 128/201.28 |
| 2,834,343 | A | * | 5/1958 | Keckler et al. | 128/202.11 |
| 2,861,569 | A | * | 11/1958 | Emerson | 128/202.22 |
| 2,881,758 | A | * | 4/1959 | Motsinger | 128/201.25 |
| 3,043,300 | A | * | 7/1962 | Flagg | 128/201.29 |
| 3,049,896 | A | * | 8/1962 | Webb | 128/201.25 |
| 3,291,126 | A | * | 12/1966 | Messick | 128/201.29 |
| 3,307,540 | A | * | 3/1967 | Link | 128/201.27 |
| 3,516,404 | A | * | 6/1970 | Spross | 128/201.25 |
| 3,525,334 | A | * | 8/1970 | Scott et al. | 128/201.25 |
| 3,777,750 | A | * | 12/1973 | Savornin | 128/201.29 |
| 3,869,871 | A | * | 3/1975 | Rybalko et al. | 62/178 |
| 4,019,508 | A | * | 4/1977 | Der Estephanian et al. | 128/202.19 |
| 4,127,122 | A | * | 11/1978 | Kienhofer et al. | 128/201.25 |
| 4,172,454 | A | * | 10/1979 | Warncke et al. | 128/201.29 |
| 4,271,833 | A | * | 6/1981 | Moretti | 128/201.29 |
| 4,403,608 | A | * | 9/1983 | Warncke | 128/201.28 |
| 4,458,680 | A | * | 7/1984 | Childers et al. | 128/201.29 |
| 4,590,951 | A | * | 5/1986 | O'Connor | 128/204.23 |
| 4,903,694 | A | * | 2/1990 | Hager | 128/204.15 |
| 5,027,807 | A | * | 7/1991 | Wise et al. | 128/201.28 |
| 5,036,842 | A | * | 8/1991 | van der Smissen et al. | 128/204.18 |
| 5,042,470 | A | * | 8/1991 | Kanesaka | 128/202.22 |
| 5,265,592 | A | * | 11/1993 | Beaussant | 128/201.24 |
| 5,293,864 | A | * | 3/1994 | McFadden | 128/201.29 |
| 5,386,823 | A | * | 2/1995 | Chen | 128/204.15 |
| 5,413,097 | A | * | 5/1995 | Birenheide et al. | 128/206.17 |
| 5,492,108 | A | * | 2/1996 | Smith et al. | 128/201.15 |
| 5,572,991 | A | * | 11/1996 | Grilliot et al. | 128/201.29 |
| 5,577,496 | A | * | 11/1996 | Blackwood et al. | 128/201.25 |

* cited by examiner

*Primary Examiner*—Aaron J. Lewis
(74) *Attorney, Agent, or Firm*—Townsend and Townsend and Crew

(57) ABSTRACT

The present invention relates to a ventilation system for a protective suit for use in hazardous environments. In a further aspect it concerns the protective suit itself. An air purifying respirator draws air from outside the protective suit through a filter, supplies filtered breathing air via a breathing hose to a space within the face piece, and supplies filtered ventilating air via a ventilating hose to the interior of the protective suit. A ventilation valve in the ventilating hose automatically closes only during periods of high breathing demand to counter a pressure drop inside the face piece.

11 Claims, 3 Drawing Sheets

VENTILATION SYSTEM FOR A PROTECTIVE SUIT

CROSS-REFERENCES TO RELATED APPLICATIONS

This is a continuation-in-part of PCT application Ser. number PCT/AU01/00384 filed Apr. 3, 2001 and designating the United States, which claimed the priority of Australian patent application PQ6644 filed Apr. 3, 2000.

FIELD OF THE INVENTION

The present invention relates to a ventilation system for a protective suit for use in hazardous environments. In a further aspect it concerns the protective suit itself.

BACKGROUND OF THE INVENTION

Protective suits are available for a range of hazardous environments, including hazardous chemicals in liquid and vapor form. One big disadvantage for workers using protective suits is that they are generally uncomfortable. To achieve good protection, the suit must be sealed to the wearer's body and therefore offers a significant barrier to heat transfer by convection, conduction, radiation and evaporation. Consequently, the temperature and humidity may rise rapidly during work. In extreme circumstances humidity approaches 100%, the body's natural cooling system stops working as no water can evaporate from the skin, blood temperature increases and, if work continues, heat stress results.

Air purifying respirators (APRs) are mounted to the suit to provide filtered air to a breathing mask for breathing and to the suit for ventilation. These devices reduce the inhalation resistance created by the filters, and increase the level of protection by creating positive pressure in the face piece. There are two types of APRs:

Constant speed respirators (PAPRs) deliver substantially constant flow rates at all times. During exhalation the air flow is wasted, and during heavy inhalation the demand often exceeds the delivery rate, resulting in negative pressure in the breathing mask and increased breathing resistance.

Demand responsive powered respirators (FPBRs) use a breathing valve and regulate fan speed to ensure positive pressure in the breathing mask under almost all conditions. During exhalation the breathing valve closes, stalling the fan, resulting in minimal wasted air.

The APR may also provide air to ventilate the suit, and in this case higher capacity battery, filters and blower are required to ensure the air flow for breathing is not compromised.

SUMMARY OF THE INVENTION

The present invention provides a ventilation system for a protective suit, including in combination:

A protective suit to cover the user's body.

A face piece to cover at least the nose or mouth of the user.

A pump unit such as an air purifying respirator to draw air from outside the protective suit through a filter, and to supply filtered breathing air via a breathing hose to a space within the face piece, and to supply filtered ventilating air via a ventilating hose to the interior of the protective suit.

A ventilation valve in the ventilating hose, automatically operable to close the ventilation valve only during periods of high breathing demand to counter a pressure drop inside the face piece.

In this way the pressure of the breathing air supplied to the face piece may be satisfactorily maintained throughout the breathing cycle.

The ventilation valve may be closed, and opened, by pneumatic or electromechanical means. For instance, a pressure tube could be used to connect a pressure signal to a servo diaphragm with spring bias. When the pressure signal reaches a predetermined threshold, the pressure acting on the diaphragm overcomes the spring bias and the valve closes.

Electromechanical means may include a solenoid, and this has the advantage of being able to respond to a more complex mix of signals than a pneumatic actuator. In either case the valve itself may operate between two states or may close progressively.

The ventilation valve may be associated with a processor that receives signals from sensors associated with the system to ensure correct automatic operation. The signals received from the sensors may include a signal representing the pressure drop across the filter, the air flow rate through the respirator of the breathing hose, or the air pressure inside the mask. The processor could operate to close the valve when the pressure drop across the filter exceeds a predetermined value, when the flow rate exceeds a predetermined value, or when the pressure inside the mask falls below a predetermined value. Any combination of flow rate and pressure may also be used by the processor to close the valve.

The pressure in the mask may be measured relative to either ambient air pressure or the pressure within the suit. Where it is measured relative to the pressure in the suit, two-level positive pressure breathing protection may be achieved, where mask pressure is maintained above suit pressure which in turn is maintained above ambient.

During periods of high breathing demand, the ventilation flow is shut off, ensuring the breathing performance of the respirator is not compromised. But during periods of low breathing demand, such as exhalation, gentle inhalation or not breathing, the otherwise idle capacity of the respirator is diverted to the suit to ventilate it.

In the case of a PAPR, the air diverted to the suit while the shut-off valve is open would otherwise have been exhausted to ambient, wasting battery capacity and reducing filter life.

In the case of an FPBR, the blower continues to operate when the shut-off valve is open and diverts air to the suit, rather than running in stalled mode and wasting battery capacity.

In either case the respirator may operate at a low pressure but at a relatively high flow rate. It may be capable of delivering at least 150 liters of air per minute, and at rates up to and beyond 300 liters per minute or 500 liters per minute.

As well as being used for ventilation, the air supplied to the suit may be used to pressurize it, which will increase protection, especially if the suit is not perfectly sealed. In this case the air delivered to the suit must exceed the leakage to maintain positive pressure in the suit. This enables the use of disposable suits with elastic seals around the wrists, ankles and breathing mask.

Valves may be fitted to the suit to allow free egress of air from the suit, but preventing inward flow in cases where the ventilation system fails. The air outlet from the suit or mask may be filtered to ensure it does not pollute, for instance, a clean room. The ventilating hose (or hoses) is also fitted with non-return valves to prevent air flowing back to the respirator when the supply pressure falls below ambient, for example, during power off operation.

An inlet valve may be provided to control the inlet of air to the pump and filter unit. The inlet valve may be arranged upstream or downstream of the fan to close when a defined air pressure is present within the pump unit. With this valve it is easier to ensure that there is always a positive pressure within the face piece at all times, and so to avoid a negative pressure which could give rise to the entry of the contaminated air.

The term filter is taken to include any device for the removal of particulate or gaseous contaminants from the inhaled air. The particulates may be solid, as in smoke, or liquid, as in insecticide sprays. The filter may be adapted to remove gaseous contaminants, in which case the filter may be in the form of activated carbon or another gaseous absorbent. Also a filter may be used to filter the exhalation air when in a decontamination room to keep the room uncontaminated.

For different applications of the breathing apparatus, different filter types are employed. Each different type of filter alters the flow resistance. The demands placed on the pump unit will also vary with each filter type as a filter is progressively used. It has been found that calibrating the pump unit prior to use, such that the speed and rotation of the fan are set at an optimum base value, results in a saving of power and an increase in filter life.

A device for drying the ventilating air may be provided, as may a device for cooling the ventilating air.

In a further aspect the invention is a gas-tight protective suit to cover a user's body, comprising:

A rear extension to house an air purifying respirator worn in a harness, and a port in the extension for air to be drawn in from outside the protective suit by the respirator.

An air-tight connection being made around the port when a filter is properly connected to the respirator so that no air may pass through the port without passing through the filter.

There may be more than one port and filter.

The protective suit may incorporate the ventilation system described above.

The protective suit may be gas tight and encapsulate the entire body of the user. The protective suit will typically comprise polyamide coated with PVC, butyl or chloroprene rubber or polymer barrier laminate. A transparent screen is provided in front of the user's face to enable him to look out.

Alternatively, the hands and feet may be covered with gloves and boots which seal against the suit. The face may also not be covered by the suit, but only by the face piece. Alternatively again, the suit itself may not be perfectly sealed, and it may be disposable.

BRIEF DESCRIPTION OF THE DRAWINGS

Examples of the invention will now be described with reference to the accompanying drawings, in which.

DESCRIPTION OF THE PREFERRED EMBODIMENTS

Figure 1:
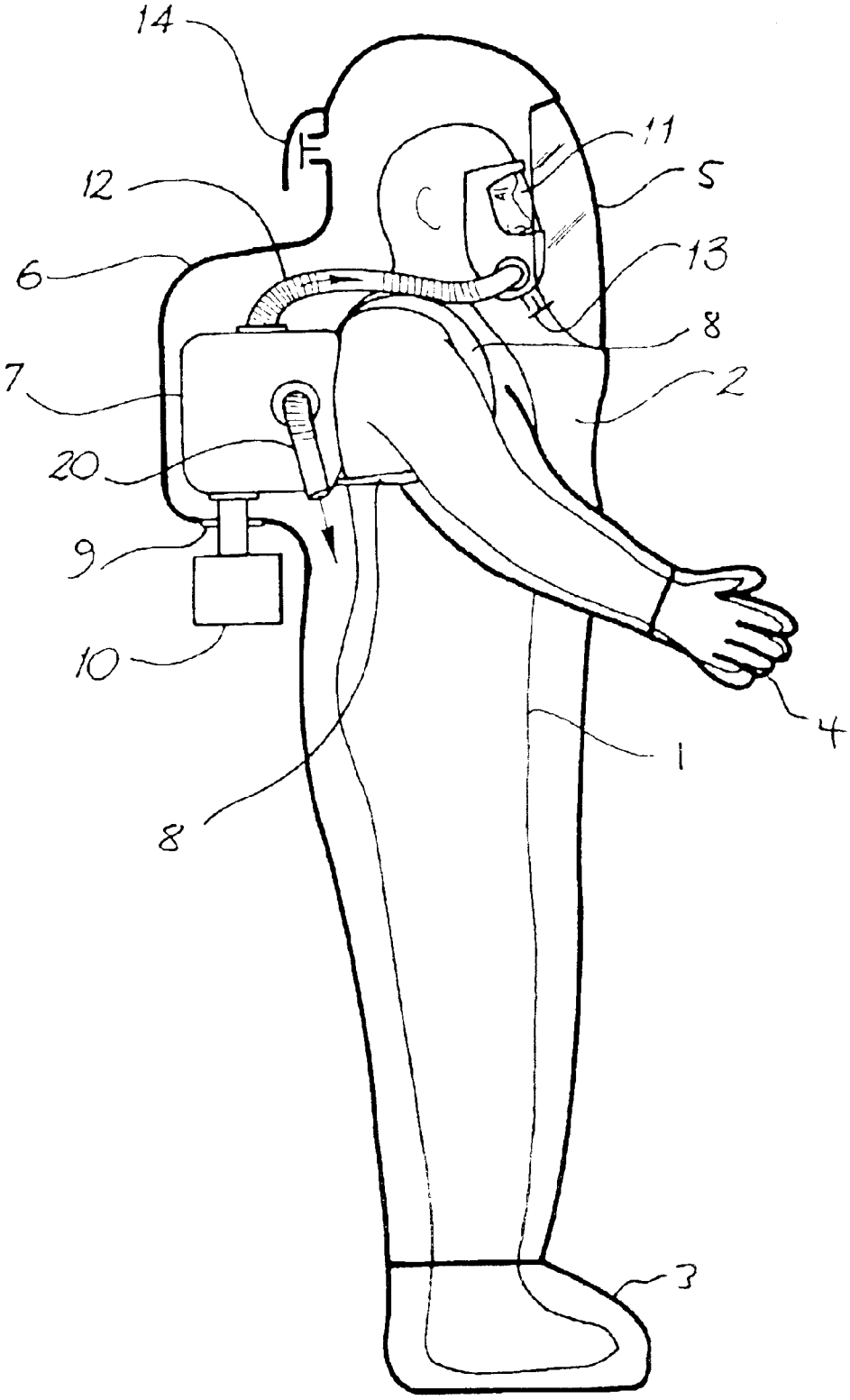
FIG. 1 is a pictorial diagram of a protective suit embodying the invention.

Referring to FIG. 1, user 1 is wearing a gas-tight polyamide protective suit 2. Boots 3 are sealed to the suit around the ankles, and gloves 4 are sealed around the wrists to provide complete protection from the environment. A transparent panel of chemical resistant PVC 5 allows the user to view the environment. An extension 6 of the suit covers an APR unit 7.

Inside the suit 2, the user wears a harness 8 to mount the APR unit 7 on his back. A hole 9 in the back of the suit provides an air inlet port for the APR unit to take atmospheric air from the environment. A filter 10 connects to the APR unit and seals hole 8 to prevent ingress of atmospheric gases into the suit. To do this the filter will screw onto a spigot extending from the APR unit and clamp a rubber seal around the hole between the filter and APR.

The APR unit 7 pumps filtered air to face piece 11 via hose 12. The air in the face piece 11 is at a higher pressure than the air within the rest of the suit, however it does not automatically vent into the suit because the exhaust valve 13 is balanced by the pressure in hose 12. During exhalation the pressure inside the face piece rises to cause the exhaust valve to open and vent into the suit. Exhaled air is vented into the suit together with incoming air from hose 12 when exhaust valve 13 opens, and provides ventilating air for the micro-environment within the suit. The ventilating air within the suit 2 is of a higher pressure than the ambient air pressure, and a second exhaust valve 14 vents this air to atmosphere when the pressure differential is sufficient.

The APR unit operates to respond to breathing demand and increase flow to the face piece when breathing demand increases, such as during strenuous exercise. This produces a corresponding increase in ventilation to the suit. The APR unit operates at a low pressure but will deliver up to in excess of 500 liters of filtered air to the face piece per minute.

Figure 2:
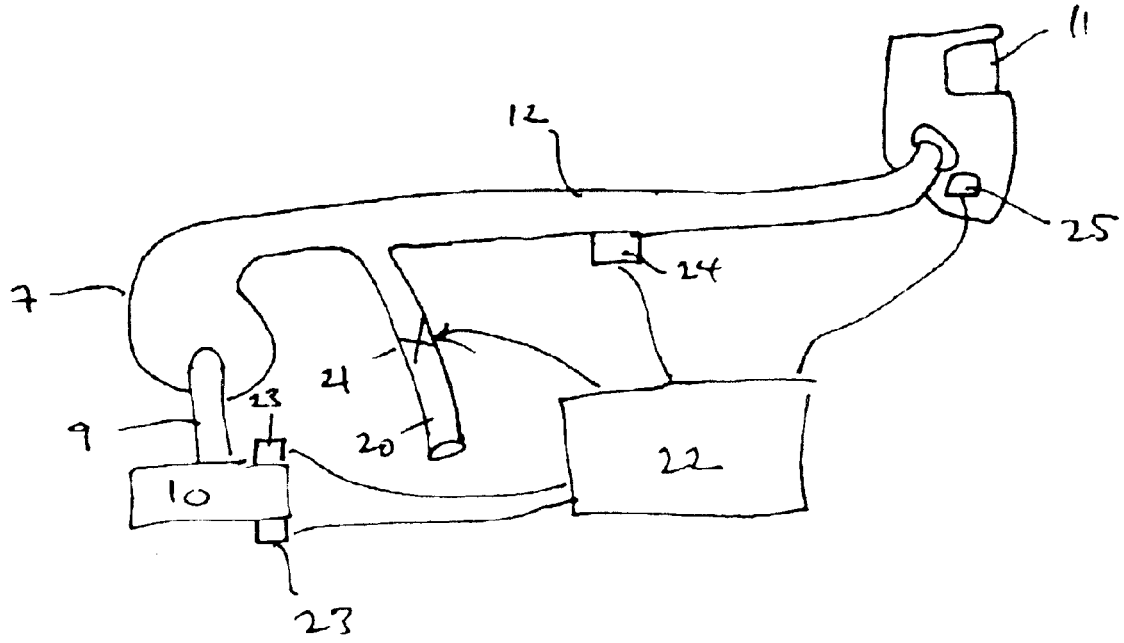
FIG. 2 is a schematic diagram of the system showing the ventilation valve and processor.

Referring now to FIG. 2, the ventilation to the suit is increased by ventilation being provided directly into the suit via ventilation hose 20. A valve 21 is positioned in the hose 20 and is controlled by a signal from processor 22. The processor in turn receives a signal from first sensors 23 which measure the pressure drop across the filter, a second sensor 24 which measures the air flow rate through the respirator or the breathing hose, and a third sensor 25 which measures the air pressure inside the mask.

The processor 22 operates to automatically close the ventilation valve 21 only during periods of high breathing demand to counter a pressure drop inside the face piece. The signals received from the processor operate to close the valve when a combination of the pressure drop across the filter, the flow rate and the pressure inside the mask satisfy the requirements of an algorithm. Such an algorithm is easily constructed by the appropriate technician from measurements made on the system, taking into account the particular application and requirements of the user. The valve in this case is closed, and opened, by electromechanical means.

The pressure in the mask may be measured relative to either ambient air pressure or the pressure within the suit. Where it is measured relative to the pressure in the suit, two-level positive pressure breathing protection may be achieved, where mask pressure is maintained above suit pressure which in turn is maintained above ambient.

Figure 3:
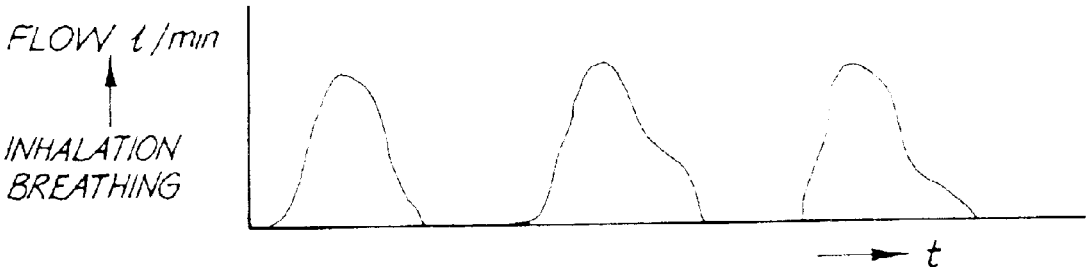
FIG. 3*a* is a graph of the flow of breathing air.
FIG. 3*b* is a graph of the flow of venting air.
FIG. 3*c* is a graph of the total flow of air.
Figure 3:
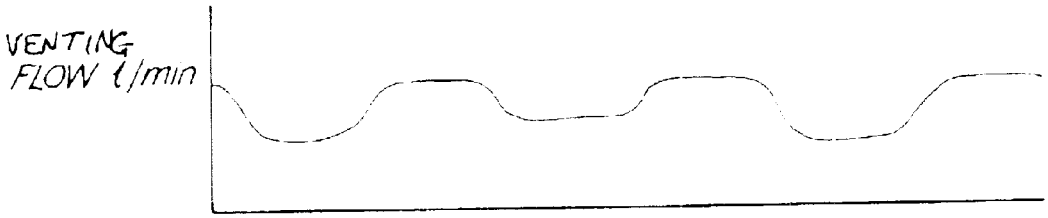
Figure 3:
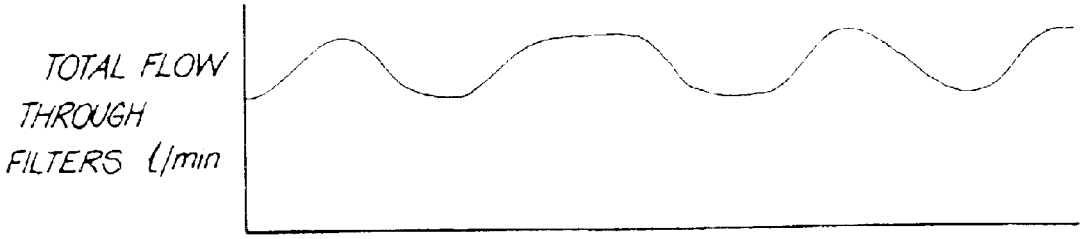

FIG. 3*a* shows the flow of air along hose 12 resulting from breathing demand. Air is only drawn during inhalation. In contrast, FIG. 3*b* shows the flow of air through the exhaust valve 13. Air flow for this purpose increases during exhalation, and falls during inhalation as some air is diverted into the lungs. FIG. 3*c* shows the total flow which can be seen to ripple up during inhalation.

Although the invention has been described with reference to a particular example, it should be understood that it could be exemplified in many other ways. For instance, different styles of protective suits may be used, including suits that allow some leakage, and disposable suits. Also, rather than using electronics, a pressure balancing arrangement may be used to operate the ventilation valve.

Additional filters may be provided at the exhaust ports to filter the breathing and ventilating air as it leaves the suit; this might be useful when the suit is to be worn in sterile environments such as clean rooms.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A ventilation system for a protective suit, including in combination:

a protective suit to cover the user's body;

a face piece to cover at least the nose or mouth of the user;

an air purifying respirator to draw air from outside the protective suit through a filter, and to supply filtered breathing air via a breathing hose to a space within the face piece, and to supply filtered ventilating air via a ventilating hose to the interior of the protective suit;

a ventilation valve in the ventilating hose automatically operable to close the ventilation valve only during periods of high breathing demand to counter a pressure drop inside the face piece.

2. A ventilation system according to claim 1, where the valve closes when the pressure drop across the filter exceeds a predetermined value, the flow rate exceeds a predetermined value, or the pressure inside the mask falls below a predetermined value, or any combination of these parameters.

3. A ventilation system according to claim 1, further including a processor to receive signals from sensors associated with the system, and control the automatic operation of the ventilation valve.

4. A ventilation system according to claim 3, where the signals received from the sensors include a signal representing the pressure drop across the filter, the air flow rate through the respirator or the breathing hose, or the air pressure inside the mask.

5. A ventilation system according to claim 1, where the valve operates between two states.

6. A ventilation system according to claim 5, where the valve operates progressively between the two states.

7. A ventilation system according to claim 1, where the air purifying respirator operates to respond to breathing demand and increase flow to the face piece when breathing demand increases.

8. A ventilation system according to claim 1, where the air purifying respirator is worn in a harness and is positioned inside the back of the protective suit where space is provided by an extension.

9. A ventilation system according to claim 8, where a port is provided in the extension for air to be drawn in from outside the protective suit by the air purifying respirator.

10. A ventilation system according to claim 9, where the filter is outside the suit and screwed to a spigot extending from the pump unit through the port.

11. A gas tight protective suit to cover a user's body, the suit comprising:

a rear extension;

a pump unit worn in a harness, the pump unit worn in a harness being held in the rear extension; and a port in the rear extension for air to be drawn in from outside the protective suit by an air purifying respirator;

wherein an air-tight connection is made around the port when a filter is properly connected to the pump unit so that no air may pass through the port without passing through the filter; the gas tight protective suit further comprising a ventilation system including a protective suit to cover the user's body; a face piece to cover at least the nose or mouth of the user; an air purifying respirator to draw air from outside the protective suit through a filter, and to supply filtered breathing air via a breathing hose to a space within the face piece, and to supply filtered ventilating air via a ventilating hose to the interior of the protective suit; a ventilation valve in the ventilating hose automatically operable to close the ventilation valve only during periods of high breathing demand to counter a pressure drop inside the face piece.

* * * * *

UNITED STATES PATENT AND TRADEMARK OFFICE

CERTIFICATE OF CORRECTION

PATENT NO. : 6,837,239 B2
DATED : January 4, 2005
INVENTOR(S) : Berndtsson et al.

It is certified that error appears in the above-identified patent and that said Letters Patent is hereby corrected as shown below:

Title page,
Item [75], Inventors, replace "Beizndtsson" with -- Berndtsson --.

Signed and Sealed this

Fourteenth Day of February, 2006

JON W. DUDAS
*Director of the United States Patent and Trademark Office*